US007066162B1

(12) United States Patent
Ng

(10) Patent No.: US 7,066,162 B1
(45) Date of Patent: Jun. 27, 2006

(54) METHOD AND APPARATUS FOR QUICK STARTING A ROPE-START TWO-STROKE ENGINE

(75) Inventor: Paul Tat-Keung Ng, Vernon Hills, IL (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 09/579,973

(22) Filed: May 26, 2000

(51) Int. Cl.
*F02P 7/077* (2006.01)
*F02P 11/00* (2006.01)

(52) U.S. Cl. ..... 123/617; 123/631; 123/179.5

(58) Field of Classification Search ..... 123/179.5, 123/603, 631, 612, 613, 617, 491, 41 E; 701/112, 701/113; 324/165
See application file for complete search history.

(56) References Cited

U.S. PATENT DOCUMENTS 4,895,120 A * 1/1990 Tobinaga et al. ..... 123/631
5,419,291 A 5/1995 Kimata et al. ..... 123/179.16
5,523,679 A 6/1996 Kalb ..... 324/165
5,816,221 A 10/1998 Krueger ..... 123/491
5,977,764 A 11/1999 Riedle et al. ..... 324/165
5,977,765 A 11/1999 Gibson et al. ..... 324/165
6,034,525 A 3/2000 Koerner et al. ..... 324/165

FOREIGN PATENT DOCUMENTS

JP 9-79125 A * 3/1997

* cited by examiner

*Primary Examiner*—Andrew M. Dolinar
(74) *Attorney, Agent, or Firm*—Osler, Hoskin & Harcourt LLP

(57) ABSTRACT

The period required to start a rope-start, two-cycle engine is reduced by enabling the engine's firing sequence to be initiated immediately upon determining the absolute rotational position of the engine and before determining the engine's direction of rotation. The rotational direction of the engine is then determined, and the firing sequence is disabled if the engine is counter-rotating. In this manner, the firing sequence is enabled much sooner in the engine's cycle than if the engine's rotational direction were determined before the firing sequence is enabled. The engine therefore starts more quickly. The method is particularly useful in battery-less engines which experience a delay in start-up due to the fact that the engine must rotate through at least part of a revolution before generating enough electrical power to operate the computer controlling operation of the engine. It is also particularly useful in short-pull engines in which manual actuation of a rope or other manually-powered starting mechanism drives the engine to rotate through no more than three-to-five revolutions.

40 Claims, 4 Drawing Sheets

ECU
52
74
78
80
62
INJECTION
64
IGNITION
I/O
MICROCONTROLLER
84
RAM
ROM
86
54
76
FLYWHEEL
SIGNAL CONDITION CIRCUIT
TIMER
70
92
56
58
66
PATTERN ON FLYWHEEL
72
96
COUNTER
94
SENSORS
A/D
CPU
88
60
82
81
90
CRANK SIGNAL GENERATION & RECOGNITION

C
B
A
66
58
54
56
β
γ
α

METHOD AND APPARATUS FOR QUICK STARTING A ROPE-START TWO-STROKE ENGINE

BACKGROUND OF THE INVENTION

The present invention relates generally to two-stroke engines and, more particularly, relates to a method and apparatus for starting a rope-start, two-stroke engine.

Rope-start, two-stroke engines are used in a variety of applications including outboard marine engines, snowmobiles, personal watercraft, snow blowers, and weed trimmers. These engines are started by manually actuating a starter mechanism that drives the engine to rotate. Engine rotation initiates a firing sequence by enabling the supply of electrical power to the engine's fuel injection and/or ignition systems at the next appropriate engine rotational position(s). The most common manually actuated starter mechanism includes a rope that is wound around a spool coupled to the engine's flywheel either directly or via one or more gears. The rope unwinds from the spool when it is pulled by the operator, thereby driving the spool and the flywheel to rotate.

Consumers demand that rope-start engines start with as little manual input as necessary. Many original equipment manufacturers demand that the engine must start on the first pull. However, starting an engine with one pull of the rope-start mechanism is hindered by several factors.

For instance, the rope-start mechanism imparts only a relatively small number of revolutions to the engine, limiting the number of available revolutions to initiate and successfully implement the engine's firing sequence. In a so-called "short-pull" engine, manual actuation of the rope-start mechanism drives the engine to rotate through no more than three-to-five revolutions. This small number of revolutions creates only a relatively small window of opportunity to initiate and successfully implement an engine firing sequence.

In addition, the engine must undergo at least part of a revolution before a firing sequence can be enabled. This limitation on engine starting stems from the fact that the absolute position of the engine must be determined before its firing sequence can be enabled. The engine's computer typically determines the engine's absolute rotational position by detecting spaced markers on a rotating component of the engine. These markers may include a plurality of equally-spaced "indicator" markers and a few additional, unequally-spaced "indexing" markers. The locations of and spacings between the markers are stored in a map or table of the computer's memory. The computer can determine the angle of rotation from a given point by counting the number of indicator markers from that point. The indexing markers form starting points and ending points for determining the engine's absolute position and direction of rotation upon engine start-up. At least two indexing markers must be detected to determine absolute engine rotational position. Specifically, upon detecting the first indexing marker, the computer resets its internal counter and begins to count the number of indicator markers between the first indexing marker and the second indexing marker. Then, upon detecting the second indexing marker, the computer can determine the angular spacing between the first and second indexing markers. The computer then compares the determined spacing to the table or map of known spacings. Based on this comparison, the computer can identify the indexing marker that is detected second and accordingly, the rotational position of the engine.

Quick engine starting is further hindered in a battery-less engine that relies on electricity generated by rotation of the engine to supply electrical power to the computer and other engine components, such as the engine's fuel injection system and/or ignition system. The typical engine must undergo at least part of a revolution, and sometimes a complete revolution or more, before generating enough power to operate the computer. This "power-up" requirement delays the computer's detection of the absolute engine rotational position and, therefore, further delays enablement of the firing sequence. All of these factors conspire to render it difficult to initiate a firing sequence in less than about one full engine revolution.

Another complicating factor that hinders quick-start and that is unique to two-stroke engines is the need to prevent engine counter-rotation. Counter-rotation occurs when the engine runs in reverse so that the crankshaft rotates in a direction opposite the intended direction. Because counter-rotation risks damage to the engine and possibly components powered by it, counter-rotation must be detected to prevent firing of the counter-rotating engine. In a system in which the engine's position is determined by detecting and identifying two indexing markers on a rotating component of the engine, counter-rotation is detected by detecting and identifying a third indexing marker disposed at an angle $\beta$ from the second indexing marker that is different from the angle $\alpha$ separating the first and second indexing markers. The engine's rotational direction can then be determined by determining the sequence in which the second and third indexing markers are detected.

Unfortunately, the need to detect and identify a third indexing marker additionally delays enablement of an engine's firing sequence and further hinders quick-start. In a short-pull engine, this additional delay in firing sequence enablement may mean the difference between a successful first pull start and an unsuccessful first pull start.

The need therefore has arisen to provide a method for quick starting a rope-start, two-cycle engine that does not require the direction of rotation of the engine to be sensed before enabling a firing sequence.

SUMMARY OF THE INVENTION

Pursuant to the invention, the period required to start a rope-start, two-cycle engine is reduced by enabling the engine's firing sequence immediately upon determining the absolute rotational position of the engine and before determining the engine's direction of rotation. The rotational direction of the engine is then determined, and the firing sequence is disabled if the engine is counter-rotating. In this manner, the firing sequence is enabled much sooner in the engine's operational cycle than if the engine's rotational direction were determined before the firing sequence were enabled. The engine therefore starts more quickly. Absolute engine rotational position and engine rotational direction may be sensed by detecting and identifying indexing markers on a rotational component of the engine and determining the sequence in which the indexing markers are detected. The indexing markers may, for instance, comprise magnetic markers (i.e., teeth or other markers made of a magnetically conductive material such as steel) that are located on the engine's flywheel or crankshaft and that are capable of being detected by a magnetic pick-up device, in which case the detector preferably comprises a magnetic pick-up device located adjacent the rotating component.

The method is particularly useful in battery-less engines, which experience a delay in start-up due to the fact that the engine must rotate through at least part of a revolution before generating enough electrical power to operate the computer controlling engine operation. It is also particularly useful in short-pull engines in which manual actuation of a rope or other manually-powered starting mechanism drives the engine to rotate through no more than three-to-five revolutions.

In accordance with another aspect of the invention, a two-stroke engine is provided with improved quick start capability. The engine includes a manually-powered starter, a monitor, an electrically powered device which controls at least one aspect of an engine's firing operation, and a computer. The starter typically comprises a pull-rope coupled to the engine's flywheel. The monitor comprises a pick-up device or other detector that detects magnetic teeth or other markers on a rotational component of the engine such as a flywheel or a crankshaft. The powered device may comprise the engine's fuel injection system and/or its ignition system or components of those systems. The computer is operable, in conjunction with the monitor, to determine an absolute rotational position of the monitored component (and hence the engine as a whole) and to enable the supply of energizing current to the powered device. Then, after enabling the supply of energizing current to the powered component, the computer determines the rotational direction of the monitored component and disables the supply of energizing current to the powered device if it determines that the monitored component is counter-rotating.

Preferably, the monitored component bears first and second angularly-spaced indexing markers, and the monitor includes a detector that is configured to detect passage of the first and second indexing markers. The computer is configured to determine an angular spacing between the first and second indexing markers and to identify the second detected indexing marker and, hence, determine the absolute rotational position of the engine based upon this determination. In order to permit the rotational direction of the engine to be determined, the monitored component preferably bears a third indexing marker that is angularly-spaced from both the first indexing marker and the second indexing marker. The computer is configured to identify the third detected indexing marker and determine the sequence of passage of the second and third detected indexing markers based upon this determination.

The engine may, for instance, comprise a battery-less engine which generates electricity to run itself from engine rotation. In this type of engine, the power-up requirement for the computer and other electrically powered components of the engine shortens the window of opportunity to start the engine after the computer powers up. Enabling the firing sequence immediately upon detecting engine absolute position therefore becomes more important in a battery-less engine than in a battery-powered engine.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

The invention is applicable to virtually any so-called "rope-start," two-stroke engine. "Rope-start," as used herein, means any engine in which the power required to start the engine is supplied manually, such as by pulling a rope coupled to a spool on the engine's flywheel. Rope-start, two-stroke engines to which the invention is applicable are usable in a wide variety of applications. These applications include outboard marine engines, snowmobile engines, snow blower engines, personal watercraft engines, and weed trimmer engines.

Figure 1:
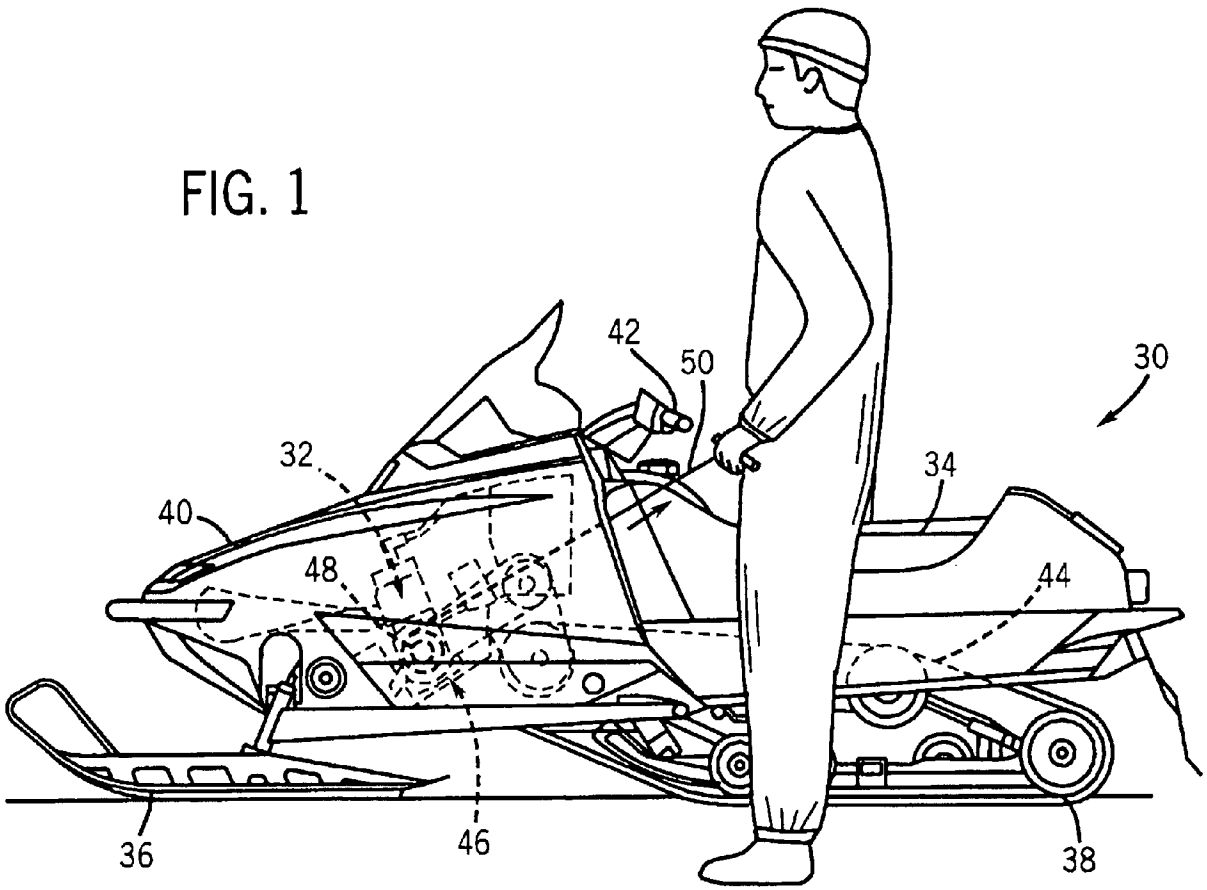
FIG. 1 is a partially schematic elevation view of a snowmobile incorporating an engine constructed in accordance with a preferred embodiment of the present invention.

Referring to FIG. 1, a snowmobile 30 is illustrated that employs an engine 32 constructed in accordance with the present invention. As is conventional, the snowmobile 30 includes a seat 34, a pair of skis 36, a track 38, a cowling 40, and a steering handlebar 42. The engine 32 is mounted under the cowling 40 and supplies motive power to the track 38 via a drive belt and pulley arrangement 44. The engine 32 comprises a rope-start, two-stroke engine, and preferably is electronically fuel injected and electronically spark ignited. It is also battery-less. The electrical power required to operate it therefore is generated by engine rotation via an alternator (not shown). A suitable rope-start, battery-less engine is disclosed in U.S. Pat. No. 5,816,221 to Krueger, the disclosure of which is hereby incorporated by reference in its entirety.

Still referring to FIG. 1, the engine 32 is started by way of a rope-start mechanism 46 operated by an operator straddling the snowmobile. The rope-start mechanism 46 includes a spool 48 and a rope 50 wound around the spool 48. The spool 48 is mounted on, or otherwise coupled to, the engine's flywheel 58. The operator starts the engine 32 by pulling the rope 50 to unwind it from the spool 48, thereby driving the spool 48 and the flywheel 58 to rotate to initiate a firing sequence.

Figure 2:
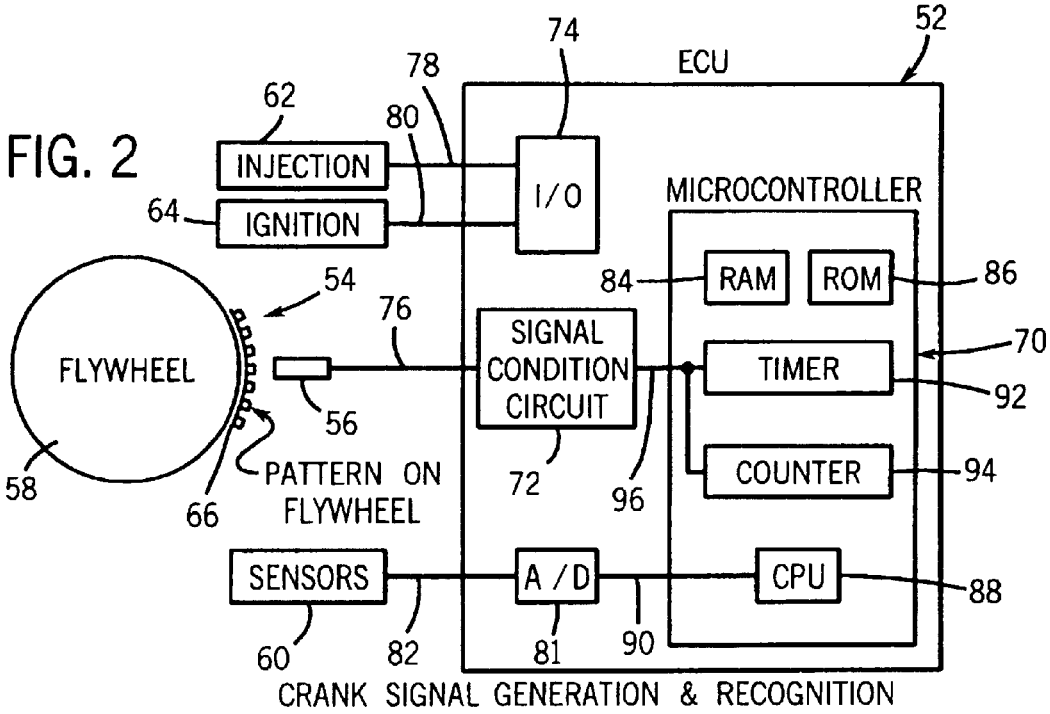
FIG. 2 is a schematic diagram of a control system for the engine of the snowmobile of FIG. 1.

Referring now to FIG. 2, the engine 32 is controlled by a control system that includes a computer or ECU 52 and a crank position monitor 54. The computer 52 receives signals from the crank position monitor 54 and possibly other sensors 60 and transmits control signals to an electronic fuel injection system 62 and an electronic ignition system 64. The crank position monitor 54 includes (1) a plurality of markers 1–24 and A–C (FIGS. 3 and 4) that are mounted circumferentially around a rotating component of the engine in an angularly-spaced apart relationship and (2) a detector 56 that detects movement of the markers past the detector 56. The rotating component bearing the markers 1–24 and A–C may comprise the crankshaft (not shown), the flywheel 58, or any other rotating engine component whose position is reflected directly or indirectly by the rotational position of the engine 32. In the illustrated embodiment, the rotational component is the engine's flywheel 58.

Figure 3:
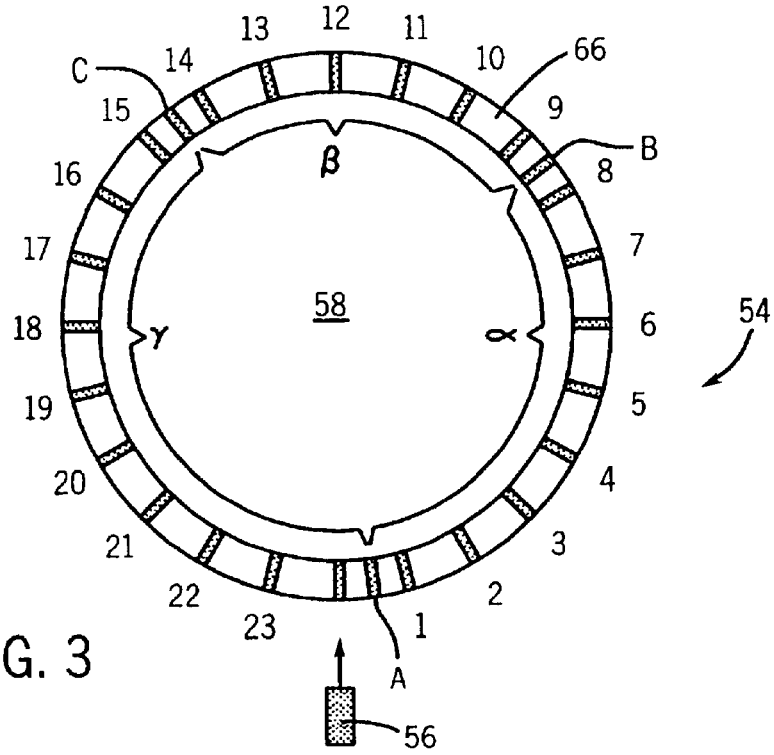
FIG. 3 is a schematic representation of a signal generating apparatus of the engine.
Figure 4:
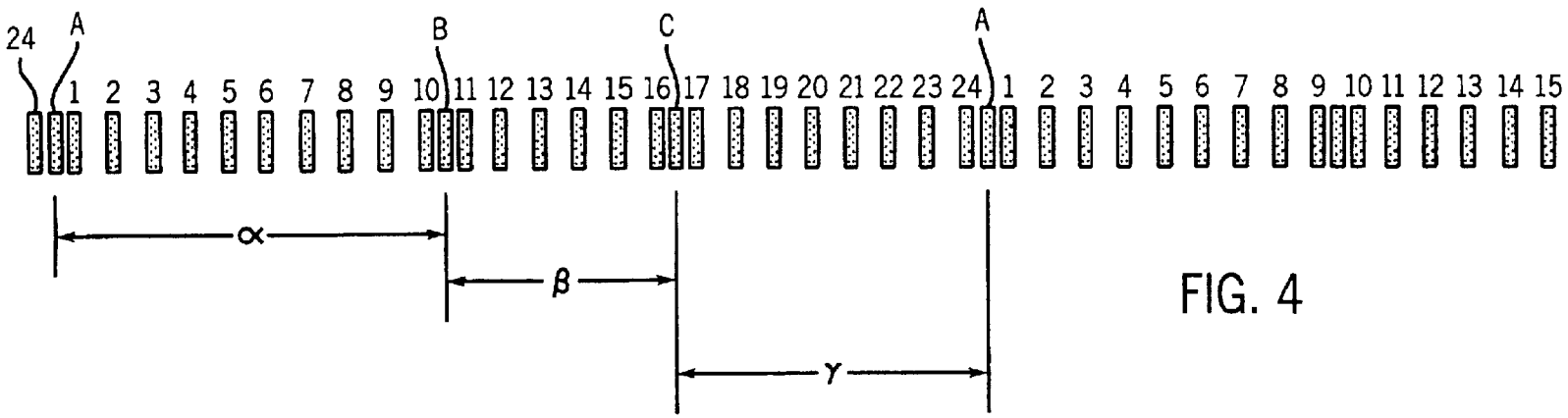
FIG. 4 is a diagram illustrating the relationship between a marker pattern and a detector of the signal generating apparatus of FIG. 3.

Referring to FIGS. 2 and 3, the markers 1–24 and A–C may comprise any devices detectable by an associated detector as the markers rotate past the detector. The illustrated markers comprise magnetic teeth mounted on a rotor 66. The rotor 66 is, in turn, mounted on the flywheel 58 so as to rotate therewith. The detector 56 may comprise any device capable of detecting the markers 1–24 and A–C. In the illustrated embodiment in which the markers comprise magnetic teeth, the detector 56 comprises a magnetic pick-up device such as a ferromagnetic transducer or a Hall effect sensor. With this type of monitor, rotation of the teeth 1–24 and A–C past the detector 56 generates magnetic pulses that are detected by the detector 56 to provide an indication of the markers' passage.

Still referring to FIG. 2, the computer 52 may comprise any programmable device capable of determining the engine's rotational position and direction of rotation based on signals from the detector 56 and of controlling the engine's fuel injection and/or ignition systems 62 and/or 64 accordingly. In the illustrated embodiment, the computer 52 comprises a programmable ECU that includes a microcontroller 70, a signal conditioning circuit 72, and an input/output device 74. The signal conditioning unit 72, which may comprise an analog-to-digital converter, is connected to the detector 56 by a transmission line 76 that converts the analog signals from the crank position monitor 54 to digital signals suitable for use by the computer 52. The input/output device 74 is coupled to the fuel injection and ignition systems 62 and 64 by respective transmissions lines 78 and 80. If additional sensors 60 are used to assist in the control of fuel injection and ignition, then the computer 52 may additionally comprise an analog-to-digital converter 81 that is coupled to the additional sensors 60 via a transmission line 82. The microcontroller 70 includes a pair of memory devices: a RAM 84 and a ROM 86, a CPU 88, a timer 92, and a counter 94. The CPU 88 is coupled to the A/D converter 81 by a transmission line 90. The timer 92 and counter 94 are connected to the signal conditioning circuit 72 by a transmission line 96 so as to count pulses generated by the detector 56 and the time between those pulses.

The data obtained from the monitor 54 can be compared with information stored in the ROM 86 regarding the spacings between and locations of the markers 1–24 and A–C to obtain information regarding the engine's current operation state, including its absolute rotational position, its speed, and its direction of rotation. Specifically, referring to FIGS. 3 and 4, the markers comprise a first plurality (24 in the illustrated embodiment) indicator markers 1–24 and three additional indexing markers A–C disposed in an angularly spaced-apart relationship on the rotor 66. The indicator markers 1–24 are spaced at equal intervals of 15°. The indexing markers A–C are spaced non-uniformly around the rotor 66 so that the indexing marker B is spaced at an angle $\alpha$ from the indexing marker A and the indexing marker C is spaced at an angle $\beta$ from the indexing marker B and an angle $\gamma$ from the indexing marker A. In the illustrated embodiment, $\alpha$ equals 150°, $\beta$ equals 90°, and $\gamma$ equals 120°. Other angles may be used so long as $\alpha$, $\beta$, and $\gamma$ are all non-equal. The timer 92 and counter 94 of the microcontroller 70 are able to count the number of markers detected by the detector 56 and to measure the interval of time between each successive marker's passage. Because this time interval is constant for adjacent indicator markers but decreases by about half for the additional indexing markers, the computer 52 is able to detect the passage of an indexing marker by noting a decreased interval between pulses when compared to intervals between the indicator markers. The computer 52 can also obtain an indication of the angle between successively detected indexing markers A–C simply by counting the number of pulses between indexing markers A–C. Hence, in the illustrated embodiment, the computer 52 can obtain an indirect measurement of the angle ($\alpha$) between the indexing markers A and B by counting the number of pulses (10) between those indexing markers. The counted number is then compared to known numbers stored in the ROM 86 to identify the second detected indexing marker B.

The computer 52 can determine the rotational direction of the engine 32 simply by determining the sequence in which two consecutive indexing markers are detected. For instance, if the counted pulses reflective of the angles $\beta$ and $\gamma$ are detected in sequence, the computer 52 can determine that the detector 56 has detected the indexing markers B, C, and A sequentially and that the engine 32 is rotating forwardly. Conversely, if the counted pulses reflective of the angles $\beta$ and $\alpha$ are detected in sequence, the computer 52 can determine that the detector 56 has detected the indexing markers C, B, and A sequentially and that the engine 32 is counter-rotating.

The inventive method could be implemented without detecting three indexing markers. For instance, if the indexing markers are unique in some way and the detector is capable of simultaneously detecting a particular indexing marker and identifying it as that marker, then two indexing markers could be employed. In this case, the absolute rotational position of engine could be determined immediately upon detecting and identifying the first indexing marker, and the rotational direction of the engine 32 could be determined upon detecting and identifying the second marker.

Figure 5:
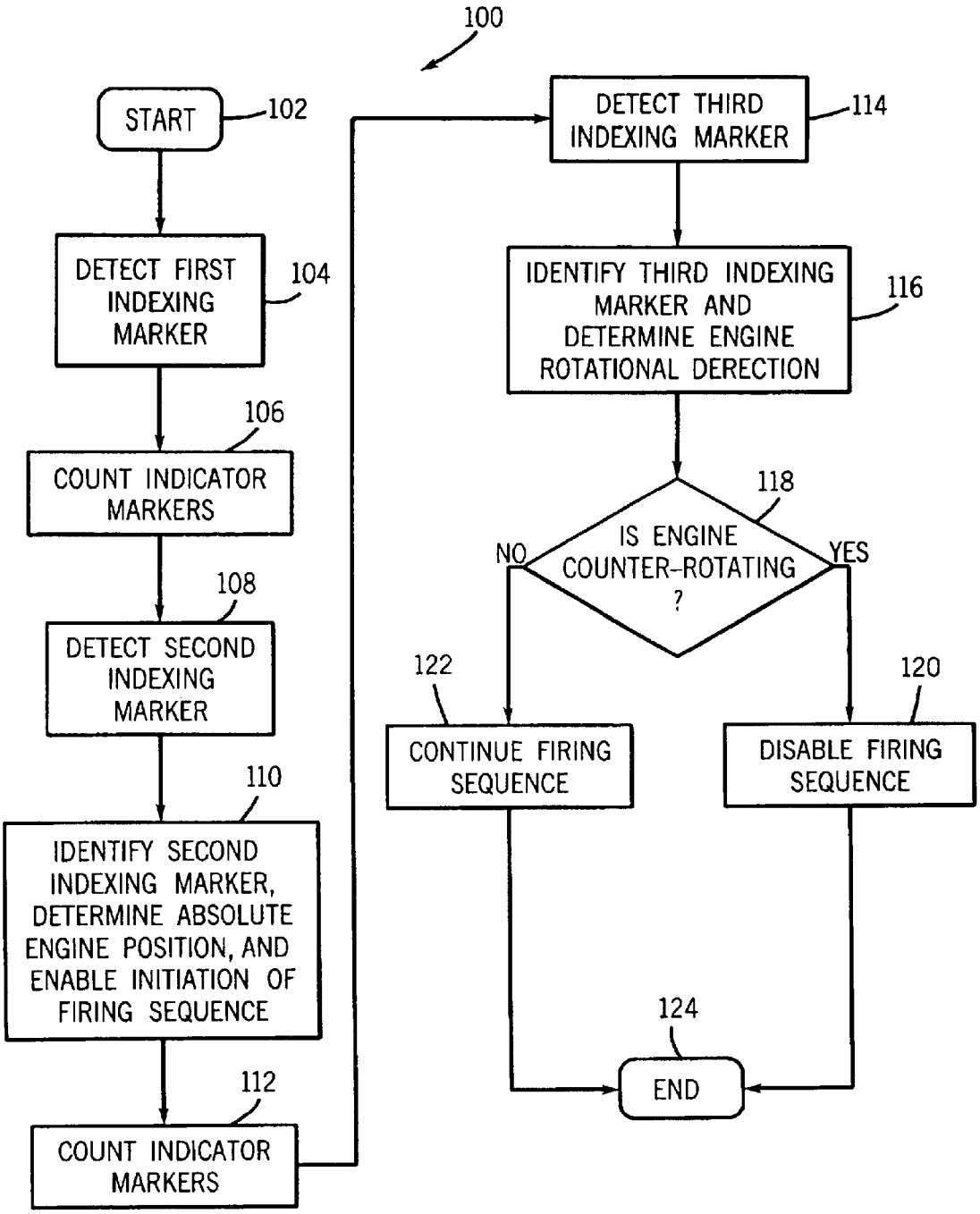
FIG. 5 is a flowchart of a firing sequence enablement/disablement control scheme performable with the engine of FIGS. 2–4.

Referring to FIG. 5, the computer 52 implements the monitoring logic described above as part of a quick start control routine 100 that enables the engine firing sequence to be initiated before the engine's rotational direction is known. Upon manual operation of the rope-start mechanism 46 and generation of sufficient electrical power to operate the computer 52, the routine 100 proceeds from START at 102 and then detects the first indexing marker (e.g., marker B in FIGS. 3 and 4) at 104. The routine 100 then resets the counter 94 and counts the indicator markers at 106 until the second indexing marker (e.g., marker A in FIGS. 3 and 4) is detected at 108. The routine 100 then compares the counted number to the numbers corresponding to the three known angles (a, A, o). Based on this comparison, the routine 100 identifies the second detected marker as a specific indexing marker (marker A in this example) and determines the absolute rotational position of the engine 32 from the known position of that indexing marker at 110. In accordance with the invention, the firing sequence of the engine 32 is enabled at this time, despite the fact that the rotational direction of the engine 32 is not yet known. The electronic fuel injection and ignition systems 62 and 64 will then be energized by the computer's input/output device 74 at the next appropriate times during the engine's cycle, e.g., at the next 30° BTDC and at TDC, respectively. Because the firing sequence is enabled relatively early in the rotational cycle of the engine 32, the chances of a successful first-pull start are maximized.

As the engine 32 continues to rotate, the routine 100 counts indicator markers at 112 until it receives an indication of the rotation of the third and final indexing marker (marker C in this example) past the detector 56 at 114. Routine 110 then identifies the third detected indexing marker at 116 by comparing the counted number of pulses to the table of known numbers stored in the ROM 86. Then, by determining the sequence that the second and third identified markers A and C pass the detector 56, the routine 100 determines at 118 whether the engine 32 is counter-rotating. In the present example, by determining that the markers A and C rotate past the detector 56 in sequence, the routine 100 determines that the engine 32 is counter-rotating. It therefore disables the firing sequence at 120 and then proceeds to END at 124. Although one or, at most, a few incidents of fuel injection and/or ignition may occur before the firing sequence is disabled, these few incidents do not have any significant detrimental effect on engine operation or on the environment. If, on the other hand, the routine 100 determines at 118 that the engine 32 is not counter-rotating, then the firing sequence is continued at 122 and the routine 100 proceeds to END at 124.

The action taken by the computer 52 after implementation of the END step 124 varies depending on the operational state of the engine 32 at that time. If END occurs following disabling of the firing sequence at 120 due to engine counter-rotation, then the computer 52 simply shuts down until the next attempt to start the engine 32. If, on the other hand, END occurs without disabling the firing sequence, then a separate routine is implemented in which the computer 52 and monitor 54 continue to monitor engine rotation and to control the injection and ignition systems 62 and 64 as the engine 32 runs. If the engine 32 counter-rotates at any time (due, for example, to backfiring), then the computer 52 will disable subsequent firing sequences and shut down the engine 32.

Many changes and modifications may be made to the invention without departing from the spirit thereof. Some of these changes are discussed above. The scope of other changes will become apparent from the appended claims.

I claim:

1. A method of starting a two-stroke battery-less engine, comprising:

(A) driving a rotational component of the engine to rotate by manually actuating a rope-start mechanism to provide power to a control system and thereafter;

(B) detecting rotation of the component through first and second rotational positions thereof;

(C) determining, based on the detecting step, an absolute rotational position of the component, the determining step occurring before the component rotates more than 270°; then (D) enabling an engine firing sequence immediately upon determining the absolute rotational position of the engine, the enabling step comprising enabling the supply of energizing current to at least one of am electronic injection system of the engine and an electronic ignition system of the engine; then (E) detecting rotation of the component through a third position which is angularly spaced unequally from the first position and from the second position; then (F) determining, based on the step (E), whether the component is rotating in a forward direction or a reverse direction; and (G) disabling the engine firing sequence if it is determined in stop (F) that the engine is running in the reverse direction.

2. The method as in claim 1, wherein the detecting steps comprise detecting rotation of first, second, and third indexing markers on the component past a detector located adjacent the component and identifying at least the second and third indexing markers.

3. The method as in claim 2, wherein the determining step (D) comprises determining a sequence that the identified markers are detected.

4. The method as in claim 3, wherein the second indexing marker is located at a first angular spacing $\alpha$ from the first indexing marker and a second angular spacing, $\beta$ from the third indexing markers wherein $\alpha$ is not equal to $\beta$, wherein a plurality of equally-spaced indicator markers are provided on the component, and wherein the step of determining the sequence that the identified markers are detected comprises counting the number of additional markers between the first and second indexing markers and the second and third indexing markers.

5. The method as in claim 1, wherein the engine rotates at least one revolution after initiation of the driving step before generating enough power to run the engine.

6. The method as in claim 5, wherein the driving step drives the engine to rotate through no more than three revolutions.

7. A signal generating apparatus of an engine comprising:

a plurality of indicator markers spaced apart from one another and positioned about a periphery of a rotational component;

a plurality of indexing markers spaced apart from one another and positioned about the periphery of a rotational component;

wherein the plurality of indexing markers is less in number than that of the plurality of indicator markers and where the plurality of indexing markers are unequally spaced apart;

a detection apparatus to detect movement of the indexing and indicator marks and enable an engine to so after detecting rotational position regardless of rotational direction; and at least three indexing markers wherein a second indexing marker is located at a first angular spacing $\alpha$ from a first indexing marker and a second angular spacing $\beta$ from a third indexing marker, where $\alpha$ is not equal to $\beta$.

8. The signal generating apparatus of claim 7 wherein the plurality of indicating markers are equally spaced apart.

9. The signal generating apparatus of claim 7 further comprising a rotatable flywheel having the signal generating apparatus mounted thereto.

10. The signal generating apparatus of claim 9 further comprising a detector mounted stationary with regard to the rotatable flywheel and arranged to detect a passage of each indicator marker and indexing marker as the rotatable flywheel rotates about the detector.

11. The signal generating apparatus of claim 9 further comprising:

a manual, battery-less start mechanism to start an engine and rotate the rotatable flywheel; and a control system connected to receive signals from the detector and responsive thereto;

determine an absolute rotational position of the rotatable flywheel based on two of the indexing markers during a single pull of the manual, battery-less start mechanism;

enable an engine firing sequence upon the single pull of the manual, battery-less start mechanism;

determine rotational direction of the rotatable flywheel; and disable the engine firing sequence if it is determined that the rotational direction is in a reverse direction.

12. The signal generating apparatus of claim 8 further comprising a memory unit having stored therein a set of numbers indicative of the plurality of equally spaced indicating markers that are located between each unequally spaced indexing marker.

13. The signal generating apparatus of claim 12 further comprising a control system capable of differentiating between the unequally spaced indexing markers based on the number of equally spaced indicating markers therebetween.

14. A method of manufacturing a two-stroke engine to enable starting in a single manual pull comprising:

providing a manually driven two-stroke engine, which upon manual rotation of the engine, an alternator provides power to a control system of the engine;

arranging a plurality of indicator markers in a spaced apart relation on a rotational component of the engine;

arranging a plurality of indexing makers about the plurality of indicating markers such that a number of indicating markers between each two indexing markers are unequal for determining an absolute rotational position of the rotational component; and upon determining the absolute rotational position of the component, enabling engine firing regardless of rotational direction, all during a single manual pull of the manually driven two-stoke engine.

15. The method of claim 14 wherein the arrangement allows for determining a rotational direction of the rotational component based on continued monitoring of the rotation of the rotational component, and disabling the engine firing sequence if it is determined that the component is running in a reverse direction.

16. A method of starting a two-stroke engine comprising:

(A) manually driving a rotational component of the engine to rotate;

(B) determining an absolute rotational position of the component;

(C) enabling an engine firing sequence upon determining the absolute rotational position of the component; then (D) determining a rotational direction of the component based on continued monitoring of the rotation of the component; and then (E) disabling the engine firing sequence if is determined in step (D) that the component is running in a reverse direction;

wherein the step of determining the absolute rotational position of the component comprises detecting rotation of first and second angularly-spaced indexing markers on the component past a detector and identifying the second detected indexing marker and detecting rotation of a third indexing marker on the component past the detector and identifying the third indexing marker and determining a sequence that the identified indexing markers are detected; and wherein the second indexing marker is located at a first angular spacing a from the first indexing marker and a second angular spacing $\beta$ from the third indexing marker, wherein $\alpha$ is not equal to $\beta$, wherein a plurality of equally-spaced indicator markers are provided on the component, and wherein the step of determining the sequence that the identified indexing markers are detected comprises counting the number of indicator markers between the first and second indexing markers and the second and third indexing markers.

17. A method of starting a two-stroke battery-less engine, comprising:

(A) driving a rotational component of the engine to rotate by manually actuating a rope-start mechanism, the component comprising one of a crankshaft and a flywheel;

(B) detecting rotation of the component through first and second rotational positions thereof;

(C) determining, based on the detecting stop, an absolute rotational position of the component, the determining step occurring before the component rotates more than 270°; then (D) enabling an engine firing sequence immediately upon determining the absolute rotational position of the engine, the enabling step comprising enabling the supply of energizing current to at least one of am electronic injection system of the engine and an electronic ignition system of the engine; then (E) detecting rotation of the component through a third position which is angularly spaced unequally from the first position and from the second position; then (F) determining, based on the step (E), whether the component is rotating in a forward direction or a reverse direction;

(G) disabling the engine firing sequence if it is determined in step (F) that the engine is running in the reverse direction;

wherein the detecting steps comprise detecting rotation of first, second, and third indexing markers on the component past a detector located adjacent the component and identifying at least the second and third indexing markers;

wherein the determining step (D) comprises determining a sequence that the identified markers are detected; and wherein the second indexing marker is located at a first angular spacing $\alpha$ from the first indexing marker and a second angular spacing, $\beta$ from the third indexing marker, wherein $\alpha$ is not equal to $\beta$, wherein a plurality of equally-spaced indicator markers are provided on the component, and wherein the step of determining the sequence that the identified markers are detected comprises counting the number of additional markers between the first and second indexing markers and the second and third indexing markers.

18. A two-stroke engine comprising:

(A) a manually-powered starter which, when actuated, drives a rotational component of the engine to rotate;

(B) a monitor which monitors rotation of the rotational component;

(C) an electrically powered device which, when energized, affects at least one aspect of an engine firing operation; and (D) a computer which is coupled to the monitor and to the powered device and which is operable, in conjunction with the monitor and the powered device, to:

(1) determine an absolute rotational position of the component, (2) enable a supply of energizing current to the powered device upon determining the absolute rotational position of the component, (3) determine, based on continued monitoring of the rotation of the component after the absolute rotational position of the component has been determined, whether the component is rotating in a forward direction or a reverse direction, and (4) disable the supply of energizing current to the powered device if it is determined that the component is mining in the reverse direction;

wherein the component has first, second, and third angularly-spaced indexing markers thereon, wherein the monitor includes a detector which is configured to detect movement of the first, second, and third indexing markers therepast, and wherein the computer is configured to identify the second and third detected indexing marker and wherein the computer is configured to determine a sequence that the identified indexing markers are detected; and wherein the second indexing marker is located at a first angular spacing $\alpha$ from the first indexing marker and a second angular spacing $\beta$ from the third indexing marker, wherein $\alpha$ is not equal to $\beta$, and wherein the computer is configured to determine the sequence that the identified indexing markers are detected by counting the number of indicator markers between the first and second indexing markers and the second and third indexing markers.

19. A two-stroke engine comprising:

(A) means, responsive to a manually-input force, for driving a rotational component of the engine to rotate;

(B) means for determining an absolute rotational position of the component;

(C) means for enabling an engine firing sequence upon determining the absolute rotational position of the component;

(D) means for determining a rotational direction of the component based on continued monitoring of the rotation of the component after the absolute rotational position of the component is determined;

(E) means for disabling the engine firing sequence if the means for determining the rotational direction of the component determines that the component is running in a reverse direction;

wherein the means (B) comprises means for detecting rotation of first and second indexing markers on the component past a designated position and determining an angular spacing between the first and second markers;

wherein the means (D) includes means for detecting rotation of a third indexing marker on the component past the designated position and determining a sequence that the identified indexing markers are detected; and wherein the second indexing marker is located at a first angular spacing at from the first indexing marker and a second angular spacing $\beta$ from the third indexing marker, wherein $\alpha$ is not equal to $\beta$, wherein a plurality of equally-spaced indicator markers are provided on the component, and wherein the means (D) comprises means for counting the number of indicator markers between the first and second indexing markers and the second and third indexing markers.

20. A snowmobile comprising:

a frame;

a steering handlebar disposed on the frame;

at least one ski disposed on the frame and operatively connected to the steering handlebar;

a drive track rotatably disposed on the frame to propel the snowmobile;

a two-stroke engine operatively connected to the drive track to supply motive power thereto;

a rope-start mechansim operatively connected to the engine for starting the engine;

a rotational component driven by the rope-start mechanism;

the rotational component having first and second angularly-spaced indexing markers;

a detector for detecting the angularly spaced marker; and a control system powered by the rotation of the rotational component and constructed to:

(A) determine an absolute rotational position of the component within a time as minimal as less than a single revolution of the engine after sufficient power to energize the control system has been generated by detecting rotation of the first and second angularly-spaced indexing markers past the detector and identifying the second detected indexing marker;

(B) enable an engine firing sequence firing sequence upon determining the absolute rotational position of the component to start the engine upon a single actuation of the rope-start mechanism; then (C) determine a rotational direction of the component based on continued monitoring of the rotation of the component; and then (D) disable the engine firing sequence if is determined in step (C) that the component is running in a reverse direction.

21. The snowmobile of claim 20 wherein the rope-start mechanism includes a spool and a rope around the spool, and the rope-start mechanism is actuated by pulling the rope to unwind it from the spool.

22. The snowmobile of claim 20 wherein the rotational component is a flywheel of the engine.

23. The snowmobile of claim 20 wherein the rotational component further includes a third indexing marker.

24. The snowmobile of claim 23 wherein the second indexing marker is located at a first angular spacing from the first indexing marker and a second angular spacing from the third indexing marker, wherein the first angular spacing is not equal to the second angular spacing.

25. The snowbobile of claim 24 wherein the rotational component further includes equally spaced indicator marker.

26. The snowmobile of claim 20 further comprising an electronic fuel injection system.

27. The snowmobile of claim 20 wherein the engine is a battery-less engine.

28. A method of starting a two-stroke engine comprising:

(A) manually driving a rotational component of the engine to rotate and provide power to a control system;

(B) determining an absolute rotational position of the component within a time as minimal as less than a single revolution of the engine after generating sufficient power to energize the control system by detecting rotation of first and second angularly-spaced indexing markers on the component past a detector and identifying the second detected indexing marker;

(C) enabling an engine firing sequence upon determining the absolute rotational position of the component to start the engine upon a single performance of step (A); then (D) determining a rotational direction of the component based on continued monitoring of the rotation of the component; and then (E) disabling the engine firing sequence if it is determined in step (D) that the component is running in a reverse direction.

29. The method as in claim 28, wherein the step of determining the rotational direction of the engine comprises detecting rotational of a third indexing marker on the component past the detector and identifying the third indexing marker.

30. The method as in claim 29, wherein the determining step comprises determining a sequence that

31. The method as in claim 30, wherein the second indexing marker is located at a first angular spacing $\alpha$ from the first indexing marker and a second angular spacing $\beta$ from the third indexing marker, wherein $\alpha$ is not equal to $\beta$, wherein a plurality of equally-spaced indicator markers are provided on the component, and wherein the step of determining the sequence that the identified indexing markers are detected comprises counting the number of indicator markers between the first and second indexing markers and the second and third indexing markers.

32. The method as in claim 28, wherein the markers are magnetic markers, and wherein the detecting step comprises detecting rotation of the magnetic markers past a magnetic pick-up device located adjacent the component.

33. The method as in claim 28, wherein the enabling step comprises enabling the supply of energizing current to at least one of an electronic fuel injection system of the engine and an electronic ignition system of the engine.

34. The method as in claim 28, wherein the engine is a battery-less engine which generates electricity to run the engine from rotation thereof, and further comprising beginning to generate electrical power immediately upon manually driving the component to rotate, and wherein the engine rotates at least one revolution after initiation of the manually driving step before generating enough power to run the engine.

35. The method as in claim 34, wherein the manually driving step drives the engine to rotate through no more than three revolutions.

36. The method as in claim 35, wherein the manually driving step drives the engine to rotate through no more than three revolutions.

37. The method as in claim 34, wherein the engine is a snowmobile engine.

38. The method as in claim 28, wherein the manually driving step comprises manually pulling a rope-start mechanism.

39. The method as in claim 28, wherein the rotational component is a flywheel of the engine.

40. The method as in claim 28, wherein the engine is a snowmobile engine.

* * * * *